United States Patent [19]

Smith, Jr. et al.

[11] Patent Number: 4,613,849

[45] Date of Patent: Sep. 23, 1986

[54] INTERFERENCE WARNING DEVICE

[75] Inventors: Roger Smith, Jr., Georgetown; Joseph R. Priest, Austin; Faustyn C. Langowski, Georgetown; Harry D. Hebard, Round Rock, all of Tex.

[73] Assignee: Hughes Tool Company, Houston, Tex.

[21] Appl. No.: 603,258

[22] Filed: Apr. 23, 1984

[51] Int. Cl.[4] ..... G08B 21/00

[52] U.S. Cl. ..... 340/679; 175/40; 212/153; 254/283; 340/522; 340/686; 340/685

[58] Field of Search ..... 340/679, 522, 686, 685; 254/283, 284, 285, 286; 212/153; 414/22; 175/40, 45

[56] References Cited

U.S. PATENT DOCUMENTS

| | | | |
|---|---|---|---|
| 2,634,405 | 4/1953 | Van Stone et al. | 340/685 |
| 2,683,779 | 7/1954 | Dishman | 340/686 |
| 3,918,037 | 11/1975 | Hall | 340/685 |
| 4,042,123 | 8/1977 | Sheldon et al. | 214/2.5 |
| 4,269,554 | 5/1981 | Jackson | 414/22 |
| 4,300,134 | 11/1981 | Paciorek | 340/685 |
| 4,334,217 | 6/1982 | Nield et al. | 340/685 |
| 4,345,539 | 8/1982 | Williams | 212/153 |

OTHER PUBLICATIONS

"Arm Interference Warning Device Ass'y," BJ—Hughes, Inc., Dec. 4, 1981.

"Racking Arm Alarm System," F. K. Smith, Mar. 2, 1982.

*Primary Examiner*—Glen R. Swann, III

*Attorney, Agent, or Firm*—Robert A. Felsman; H. Dennis Kelly

[57] ABSTRACT

An interference warning device for an oil well drilling rig having a derrick, traveling equipment, a racker arm, and a block retractor. Fluid activated sensors provide electric signals when the traveling equipment is within a selected vertical distance from the racker arm, when the racker arm is within a selected horizontal distance from the vertical axis of the derrick, or when the block retractor has extended the traveling equipment to within a selected distance from the fully extended position. The operator is informed when any one of the sensors is activated, cautioned when any two of the sensors are activated, and warned when all three sensors are activated. The drawworks may be braked when all three sensors are activated.

5 Claims, 2 Drawing Figures

INTERFERENCE WARNING DEVICE

BACKGROUND OF THE INVENTION

1. Field of the Invention

This invention relates in general to oil well drilling equipment, and in particular to interference warning devices for preventing collisions between components of an oil well drilling rig.

2. Description of the Prior Art

In a typical oil well drilling rig, a traveling block and hook are suspended from the derrick crown block by a series of cables which are driven by the derrick drawworks to raise and lower the traveling block along the vertical axis of the drilling rig. A block retractor is provided, in some cases, to retract the traveling block away from the vertical axis of the derrick, or to extend the traveling block over the vertical axis. A pair of links and a derrick elevator are suspended from the hook, and support lengths of drill pipe or casing as the lengths of drill pipe or casing are added to or removed from the drill string. As the traveling equipment moves up and down along the vertical axis of the derrick, there is a danger of collision between the traveling equipment and other equipment which extends over the vertical axis of the derrick.

Racker arms, attached to the side of the derrick, extend over the vertical axis of the derrick to grip lengths of drill pipe or casing and to move the lengths between the vertical axis of the derrick and a pipe rack offset from the vertical axis. When the racker arm is extended over the vertical axis of the derrick, and the block retractor has extended the traveling equipment over the vertical axis, there is a possibility of collision. Various interference warning devices have been devised to warn the derrick operator of an impending collision. These warning devices emit a single warning when two pieces of equipment have been moved into a danger area. Since one or both pieces of equipment may be moving at a rather high rate of speed, the time lapse between the warning and the collision may be quite small, giving the operator little reaction time in which to prevent the collision or to minimize the damage.

The sensors used in prior art warning devices have been electronic sensors, such as electronic limit switches. These are disadvantageous, because it is desirable to limit electrical circuits attached to moving equipment in the drilling rig.

SUMMARY OF THE INVENTION

The improved interference warning device of the present invention is designed for an oil well drilling rig having a derrick, traveling equipment, a racker arm, and a block retractor. Various fluid activated sensors provide signals whenever the traveling equipment is within a selected vertical distance from the racker arm, or whenever the racker arm is within a selected horizontal distance from the vertical axis of the derrick, or whenever the block retractor has extended the traveling equipment to within a selected distance from the fully extended position. Whenever any one of the sensors provides a signal, information means provides a perceptible information signal to the derrick operator. Whenever, any two of the sensors provide signals, a caution means provides a perceptible caution signal to the operator. When all three of the sensors provide signals, the operator is warned by a perceptible warning signal provided by warning means. Each of the sensors is activated by fluid pressure, in order to eliminate electrical circuits attached to moving equipment in the derrick.

The above, as well as additional objects, features, and advantages of the invention, will become apparent in the following detailed description.

DESCRIPTION OF THE PREFERRED EMBODIMENT

Figure 1:
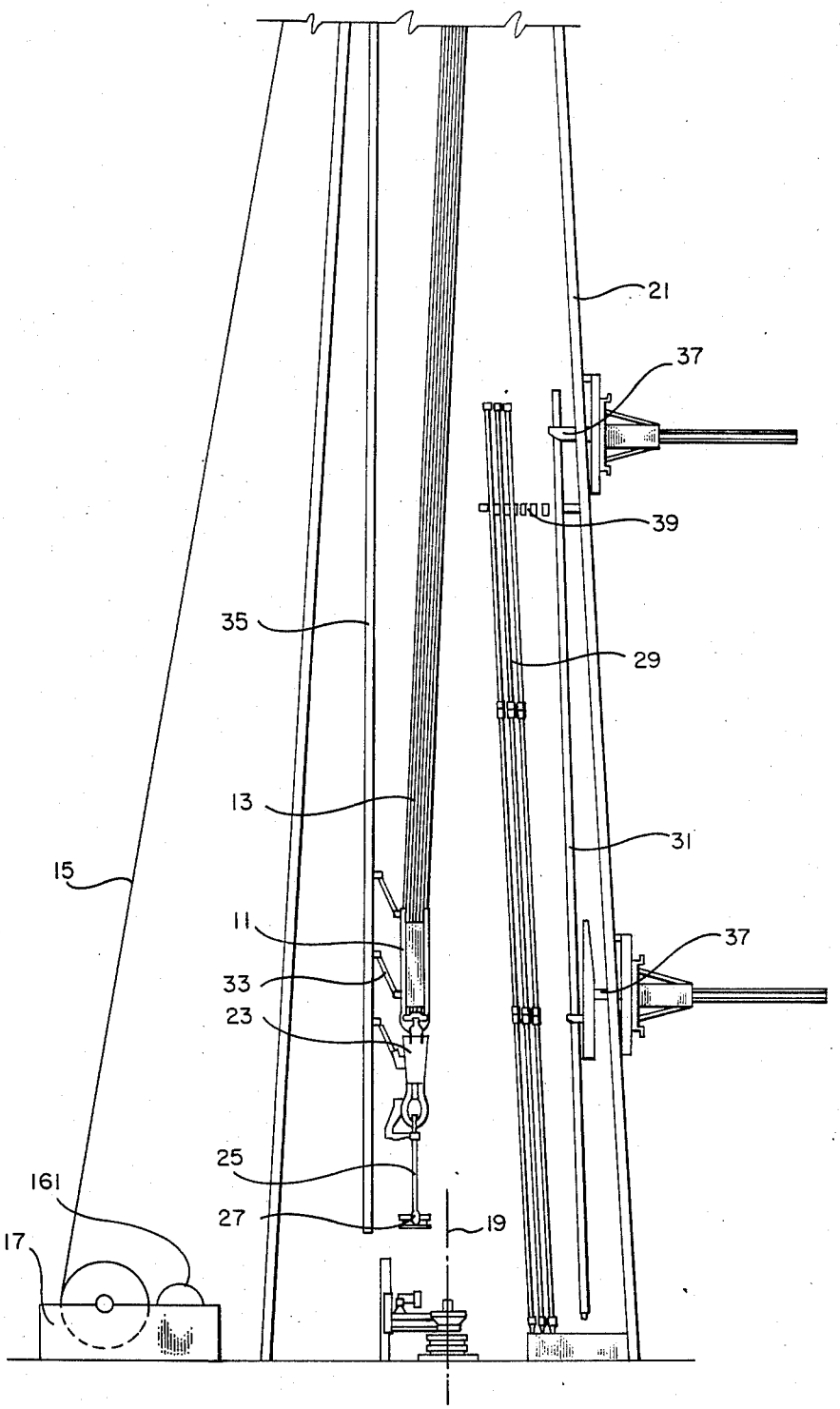
FIG. 1 is an elevational view of a typical oil well drilling rig.

FIG. 1 illustrates a typical oil well drilling rig, in which a traveling block 11 is suspended from a derrick crown block (not shown) by a series of cables 13 which are driven by a hosting cable 15 and derrick drawworks 17 to raise and lower the traveling block 11 along the vertical axis 19 of the derrick 21. A derrick hook 23, a pair of links 25, and a derrick elevator 27 are suspended from the traveling block 11, and along with the traveling block 11, make up the traveling equipment. The elevator 27 supports lengths of drill pipe 29 or casing 31, which are to be raised or lowered. A block retractor 33 moves the traveling block 11 between a retracted position away from the vertical axis 19 and a fully extended position over the vertical axis 19. As the traveling block 11 moves up and down within the derrick 21, the block retractor 33 travels along a block retractor guide 35.

One or more racker arms 37 grip the drill pipe 29 or casing 31, and move the drill pipe 29 or casing 31 between the vertical axis 19 and a pipe rack 39, which is offset from the vertical axis 19. When the racker arm 37 is extended over the vertical axis 19, there is a danger of collision between the traveling block 11 and the racker arm 37. The interference warning device of the invention is designed to warn the drilling rig operator of an impending collision, so that the operator may avoid the collision or at least minimize the damage.

Figure 2:
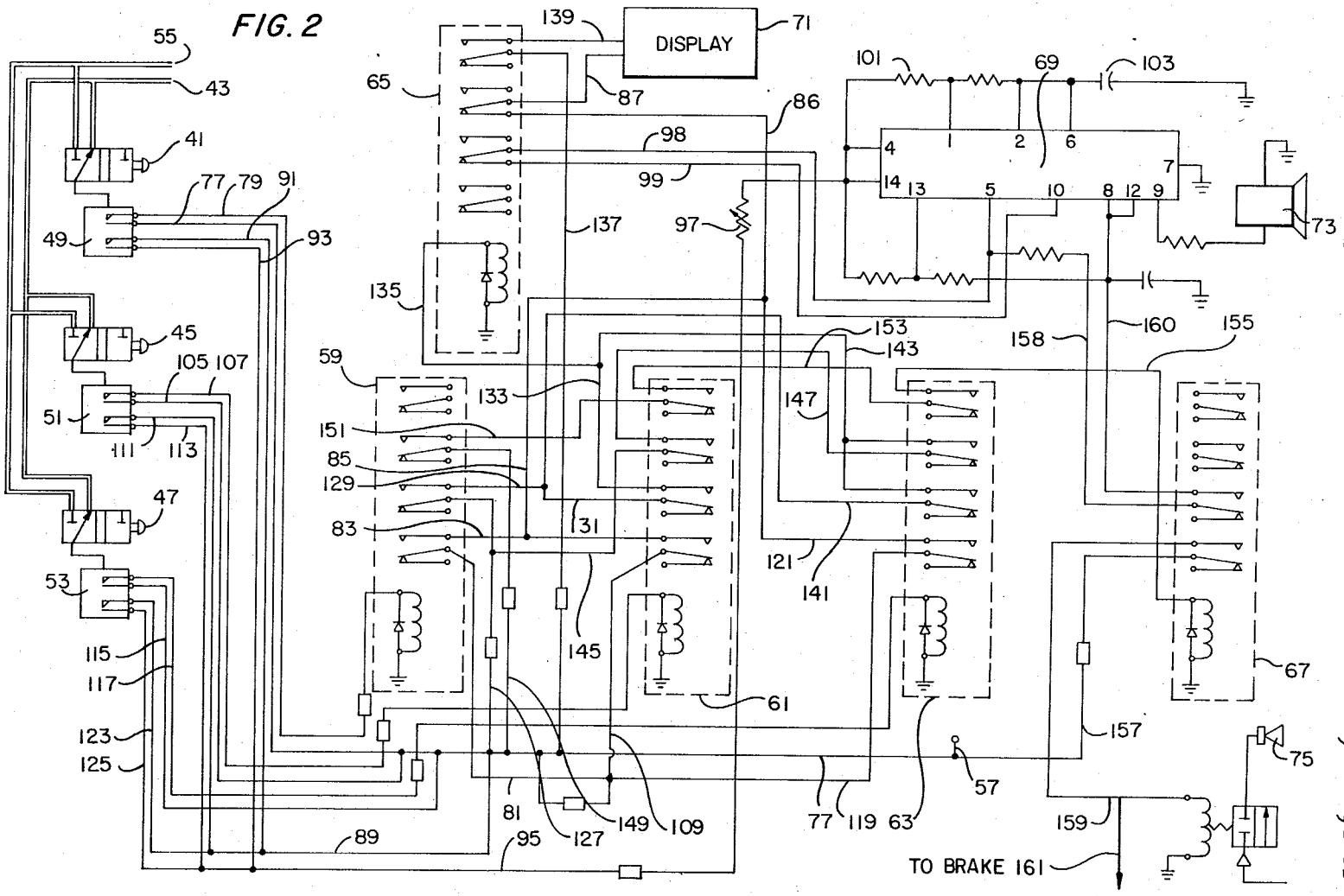
FIG. 2 is a schematic drawing of the fluid and electrical circuits of the interference warning device of the invention.

A fluid and electrical schematic drawing of the improved interference warning device is shown in FIG. 2. A fluid sensor 41, of a type well known in the prior art, is mounted on the block retractor 33. This sensor 41 is a block retractor sensing means for providing a signal when the block retractor 33 has extended the traveling equipment to within a selected distance from the fully extended position. When the traveling equipment is in the retracted position, the sensor 41 is in the position illustrated in FIG. 2, open to a case drain or exhaust 43.

Another fluid sensor 45 is a traveling equipment sensing means for providing a signal when the traveling equipment is within a selected vertical distance from the racker arm 37. When the traveling equipment is a safe distance from the racker arm 37, the sensor 45 is as shown in FIG. 2, open to the case drain or exhaust 43.

A third fluid sensor 47 senses the position of the racker arm 37 and is a racker arm sensing means for providing a signal when the racker arm 37 is within a selected horizontal distance from the vertical axis 19 of the derrick 21. The racker arm sensor 47 is in the position shown in FIG. 2, open to the case drain or exhaust 43, whenever the racker arm 37 is a safe distance away from the vertical axis 19. Each of the three fluid sensors 41, 45, 47 is connected to a corresponding pressure switch 49, 51, 43, and to a common source of fluid pressure 55.

Each of the pressure switches 49, 51, 53 activates a selected portion of the electrical components of the interference warning device, as shown in FIG. 2. The warning device is powered by a 24 volt DC power supply 57, and has five relay switches 59, 61, 63, 65, 67, and an integrated circuit 69. IC 69 is, for example, a type 556 Dual Bi-Polar Timer. The warning device receives the signals from the sensors 41, 45, 47 and routes the signals to a visual display 71, an audio warning 73 or a horn 75.

In the preferred embodiment, when any one of the sensors 41, 45, 47 provides a signal, the visual warning 71 illuminates an amber light, and the audio warning emits an intermittent tone. Whenever any two of the sensing means 41, 45, 47 provide signals, the visual warning 71 illuminates a red light, and the audio warning 73 emits a steady tone. This cautions the drilling operator that two of the three conditions for a collision exists. Whenever signals are provided by all three sensors 41, 45, 47, the visual warning 71 illuminates a red light, the audio warning 73 sounds an alternating two tone electronic signal, and the air horn 75 is sounded.

In operation, the drilling rig will always be in one of eight conditions, dependent upon the positions of the block retractor 33, the traveling equipment, and the racker arm 37. The first condition is the all safe position, i.e. the block retractor 33 has retracted the traveling equipment away from the vertical axis 19 of the derrick 21, the traveling equipment is not within a selected vertical distance from the racker arm 37, and the racker arm 37 is not within a selected distance from the vertical axis 19 of the derrick 21. In other words, neither the traveling equipment nor the racker arm 37 is within a danger zone. The three sensors 41, 43, 45 are in the positions shown in FIG. 2, and fluid pressure is not applied to any of the pressure switches 49, 51, 53. As a result, no electric current is supplied to the visual display 71, to the audio warning 73, or to the horn 75.

The second, third, and fourth possible conditions occur when a different one of the three sensors is activated. When the block retractor 33 extends the traveling equipment to within a selected distance from the fully extended position, the retractor sensor 41 is activated, and fluid pressure from the fluid pressure source 55 is applied to the pressure switch 49. Electric current from the power source 57 then flows through line 77, through the pressure switch 49, to line 79 and a relay switch 59, reversing all of the switches in the relay switch 59. Current also flows through lines 77 and 81 to relay 59, and then through lines 83, 85, and 86 to relay 65. The current then flows through line 87 to the visual warning display 71, and illuminates an amber light. Current also flows through lines 77, 89, and 91 to the pressure switch 49, and then through lines 93 and 95, and a potentiometer 97, to pins 1, 2, 4, 6, 8, 12, 13 and 14 on the integrated circuit 69. The relay switch 65 is closed between lines 98 and 99, electrically connecting pins 5 and 10 on the integrated circuit 69. In this condition, the audio warning device 73, connected between pin 9 of the integrated circuit 69, and ground emits an intermittent electronic tone. Several resistors 101 and capacitors 103 are connected between various pins of the integrated circuit 69, and determine the type of audio signal which is emitted by the audio warning 73. The amber light illuminated by the visual display 71 and the audio signal emitted by the audio warning device 73 are information means for informing the derrick operator that one of the three sensors 41, 45, 47 is providing a positive signal, and that personnel controlling the other two pieces of equipment should be alert to the possible repercussions of their actions.

In the third condition, the traveling block 11 is within an unsafe vertical distance from the racker arm 37, but the block 11 is retracted and the racker arm 37 is retracted, and only the traveling block sensor 45 is activated. Fluid pressure is applied through the sensor 45 to pressure switch 51, and current can flow from lines 77 and 105 to line 107, and then on to relay switch 61, reversing the switches in relay 61. Current can then flow to the visual display 71 through lines 77, 109, 85, 86, and 87. Current also flows through lines 77, 89, 111 to the pressure switch 51, and then through lines 113 and 95 to the integrated circuit 69. As in the second condition above, the visual display 71 illuminates an amber light and the audio warning 73 sounds an intermittent tone to inform the drilling operator that a single sensor 41, 45, 47 is sending a signal.

The fourth possible condition is when the racker arm is in the danger zone, but the traveling equipment is safe both horizontally and vertically. In this case only the racker arm sensor 47 is activated, and fluid pressure is supplied from the fluid pressure source 55 to the pressure switch 53. Current flows through lines 77 and 115 to the pressure switch 53, and then through line 117 to the relay switch 63, reversing the switches in relay 63. Current can then flow to the visual display 71 through lines 77, 119, 121, 86, and 87. Current also flows through lines 77, 89, and 123 to the pressure switch 53, and then through lines 125 and 95 to the integrated circuit 69. As in conditions two and three, the visual display 71 illuminates an amber light and the audio warning 73 sounds an intermittent tone to inform the operator that a single sensor 41, 45, 47 is sending a signal.

The fifth, sixth, and seventh conditions occur when two of the three sensors 41, 43, 45 are activated. The fifth condition is when the block retractor is extended and the traveling equipment is in the danger zone vertically, but the racker arm is in the safe zone. In this case sensors 41 and 45 are activated and fluid pressure is applied to pressure switches 49 and 51. Current flows through lines 79 and 107 to relay switches 59 and 61, respectively, to reverse the switches in the relays 59 and 61. Current also flows to relay switch 65 through lines 77, 127, 129, 131, 133, and 135, reversing the switches in the relay 65. When the switches in relay 65 have been reversed, current can flow in the visual display 71 through lines 77, 137, and 139, causing the visual display to illuminate a red light. The relay switch 65 is open between lines 98 and 99, separating pins 5 and 10 on the integrated circuit 69. This condition causes the audio warning to emit a steady tone. The red light and the steady tone are caution means for cautioning the operator that two of the sensors 41, 45, 47 are sending signals.

The sixth possible condition occurs when the block retractor is extended and the racker arm is in the danger zone, but the vertical position of the traveling equipment is safe. In this case sensors 41 and 47 are activated, and fluid pressure is applied to pressure switches 49 and 53. Relay switches 59 and 63 are reversed by currents flowing through lines 79 and 117, respectively. Relay switch 65 is reversed by current flowing through lines 77, 127, 129, 141, 143, and 135. A red light is illuminated in the visual display 71 by current flowing through lines 77, 137, and 139, and a steady tone is emitted by the audio warning, because of current flowing to the integrated circuit 69 through line 95.

When the traveling equipment is in the danger zone vertically and the racker arm is in the danger zone, but the block is retracted, the drilling rig is in the seventh condition. Sensors 45 and 47 are activated, and fluid pressure is applied to pressure switches 51 and 53. Relay switches 61 and 63 are reversed by current flowing through lines 107 and 117, respectively. Relay switch 65 is reversed by current flowing through lines 77, 127, 145, 147, 143, and 135. Current can then flow to the visual display 71 through lines 77, 137, and 139, illuminating a red light. Current flows to the integrated circuit 69 through line 95, causing the audio warning 73 to emit a steady tone. The red light and the steady tone are a caution means for cautioning the operator that two of the three conditions for a collision exist.

The last possible condition for the drilling rig is the situation when the block retractor is extended, the traveling equipment is in the danger area vertically, and the racker arm is extended over the vertical axis of the derrick. In this case all three sensors 41, 45, 47 are activated, and fluid pressure is applied to all three pressure switches 49, 51, 53. Relay switches 59, 61 and 63 are reversed by currents in lines 79, 107, and 117, respectively. Relay switch 65 is reversed by current flowing through lines 77, 127, 129, 131, 133, and 135. Current flows to the visual display 71 through lines 77, 137, and 139, to illuminate the red light, and current flows to the integrated circuit 69 through line 95. Relay switch 67 is reversed by current flowing through lines 77, 149, 151, 153, and 155. Current can then flow through lines 157 and 159 to the horn 75 to sound a warning to the operator that all three danger conditions have been met and that collision is imminent. Switch 67 also closes between lines 158 and 160, electrically connecting pin 5 to pins 8 and 12 on the integrated circuit 69. In this condition, the audio warning 73 will emit a dual warning tone. The dual warning tone and the horn 75 blast are warning means for warning the operator when all three of the sensors 41, 43, 45 are providing signals.

If desired, line 159 can be extended to the brake 161 on the drawworks 17 (FIG. 1), to brake the drawworks in order to slow the movement of the traveling equipment. The brake 161 is then a brake means for braking the drawworks in response to electric signals from all three of the sensing means 41, 43, 45.

The interference warning system of the invention has several advantages over the prior art. The fluid sensors eliminate electric circuits attached to moving equipment in the derrick. The intermediate information and caution signals give a longer time period for the operator to react before impending collision.

While the invention has been shown in only one of its forms, it should be apparent to those skilled in the art that it is not so limited, but is susceptible to various changes and modifications without departing from the spirit thereof.

We claim:

1. An interference warning device for an oil well drilling rig having a derrick, traveling equipment, a racker arm, and a block retractor, comprising:

traveling equipment sensing means for providing a signal when the traveling equipment is within a selected vertical distance from the racker arm;

racker arm sensing means for providing a signal when the racker arm is within a selected horizontal distance from the vertical axis of the derrick;

block retractor sensing means for providing a signal when the block retractor has extended the traveling equipment to within a selected distance from the fully extended position;

information means for informing an operator when any one of the sensing means provides a signal;

caution means for cautioning the operator when any two of the sensing means provide signals; and warning means for warning the operator when all three of the sensing means provide signals.

2. An interference warning device for an oil well drilling rig having a derrick, traveling equipment, a racker arm, and a block retractor, comprising:

traveling equipment sensing means, activated by fluid pressure for providing an electric signal when the traveling equipment is within a selected vertical distance from the racker arm;

racker arm sensing means, activated by fluid pressure, for providing an electric signal when the racker arm is within a selected horizontal distance from the vertical axis of the derrick;

caution means for providing a perceptible caution signal in response to an electric signal from either of the sensing means; and warning means for providing a perceptible warning signal in response to electric signals from both of the sensing means.

3. An interference warning device for an oil well drilling rig having a derrick, traveling equipment, a racker arm, and a block retractor, comprising:

traveling equipment sensing means, activated by fluid pressure, for providing an electric signal when the traveling equipment is within a selected vertical distance from the racker arm;

racker arm sensing means, activated by fluid pressure, for providing an electric signal when the racker arm is within a selected horizontal distance from the vertical axis of the derrick;

block retractor sensing means activated by fluid pressure, for providing an electric signal when the block retractor has extended the traveling equipment to within a selected horizontal distance from the fully extended position;

information means for providing a perceptible information signal in response to an electric signal from any one of the sensing means;

caution means for providing a perceptible caution signal in response to electric signals from any two of the sensing means; and warning means for providing a perceptible warning signal in response to electric signals from all three of the sensing means.

4. An interference warning device for an oil well drilling rig having a derrick, drawworks, traveling equipment, a racker arm, and a block retractor, comprising:

traveling equipment sensing means, activated by fluid pressure, for providing an electric signal when the traveling equipment is within a selected vertical distance from the racker arm;

racker arm sensing means, activated by fluid pressure, for providing an electric signal when the racker arm is within a selected horizontal distance from the vertical axis of the derrick;

block retractor sensing means, activated by fluid pressure, for providing an electric signal when the block retractor has extended the traveling equipment to within a selected horizontal distance from the fully extended position;

information means for providing a perceptible information signal in response to an electric signal from any one of the sensing means;

caution means for providing a perceptible caution signal in response to electric signals from any two of the sensing means;

warning means for providing a perceptible warning signal in response to electric signals from all three of the sensing means; and brake means for braking the drawworks in response to electric signals from all three of the sensing means.

5. A method of warning an operator of an oil well drilling rig having a derrick, traveling equipment, a racker arm, and a block retractor, providing a signal when the traveling equipment is within a selected vertical distance from the racker arm;

providing a signal when the racker arm is within a selected horizontal distance from the vertical axis of the derrick;

providing a signal when the block retractor has extended the traveling equipment to within selected distance from the fully extended position;

informing the operator when any one of the signals is provided;

cautioning the operator when any two of the signals are provided;

warning the operator when all three of the signals are provided.

* * * * *